US006468092B1

(12) United States Patent
Gräff et al.

(10) Patent No.: US 6,468,092 B1
(45) Date of Patent: Oct. 22, 2002

(54) ELECTRONIC COMPONENT, IN A PARTICULAR FOR A CONTROL DEVICE PROVIDED WITH VALVES

(75) Inventors: Uwe Gräff, Ostfildern (DE); Heinz Hohner, Esslingen (DE); Magnus Henzler, Grobbettlingen (DE); Christian Waldeck, Ostfildern (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 09/890,560

(22) PCT Filed: Dec. 5, 2000

(86) PCT No.: PCT/EP00/12198

§ 371 (c)(1),
(2), (4) Date: Aug. 1, 2001

(87) PCT Pub. No.: WO01/42664

PCT Pub. Date: Jun. 14, 2001

(30) Foreign Application Priority Data

Dec. 10, 1999 (DE) ..... 199 59 476

(51) Int. Cl.[7] ..... H01R 9/09
(52) U.S. Cl. ..... 439/76.1; 439/218
(58) Field of Search ..... 439/718, 76.1, 439/218, 638, 404, 417, 928, 364; 137/597, 884, 271, 560, 395, 554

(56) References Cited

U.S. PATENT DOCUMENTS 4,832,608 A * 5/1989 Kroll ..... 439/67
5,501,608 A 3/1996 Scheer et al.
5,996,610 A * 12/1999 Sato et al. ..... 137/271

FOREIGN PATENT DOCUMENTS

| | | |
|---|---|---|
| DE | 36 05 950 A1 | 10/1986 |
| DE | 197 14 868 A1 | 10/1998 |
| EP | 0 629 783 A1 | 12/1994 |
| EP | 0 868 008 A1 | 9/1998 |
| GB | 2 318 695 A | 4/1998 |
| WO | WO 98/20585 | 5/1998 |

* cited by examiner

*Primary Examiner*—Renee Luebke
*Assistant Examiner*—Phuongchi Nguyen
(74) *Attorney, Agent, or Firm*—Hoffman & Baron, LLP

(57) ABSTRACT

An electronic part having electrical terminals for the connection of further equipment includes at least one internal electronic unit, which is connected with the electrical terminals. The electrical terminals are part of an adapter arranged in a replaceable fashion on a base having the internal electronic unit. The adapter possesses a standardized first electrical interface connected with the electrical terminals, which on mounting and dismounting the adapter on and from a standardized second electrical interface connected with the internal electronic unit and mounted on the base, are contacted and put out of contact with the first interface coming into and out of electrical contact with the standardized second electrical interface, which are provided on the base and are connected with the internal electronic unit.

21 Claims, 3 Drawing Sheets

ELECTRONIC COMPONENT, IN A PARTICULAR FOR A CONTROL DEVICE PROVIDED WITH VALVES

FIELD OF THE INVENTION

The invention relates to an electronic part more especially for a control means having valves, comprising externally accessible electrical terminal or connection means for the connection of at least one electrical conductor leading to external equipment, and at least one internal electronic unit, which is connected with the electrical terminal means electrically.

BACKGROUND OF THE INVENTION

The European patent publication 0 629 783 A1 discloses a control means having valves, which is employed for the control of fluid power operated drives. In addition to the valve part comprising the valves the control means furthermore comprises a modularly designed electronic part including several electronic modules, which is provided with electrical input and output terminals rendering possible the connection of, for example, sensors and of electrically operated actuators. In order to be able to connect such components the electronic part is provided with externally accessible terminal means, which are for example based on plug and socket technology and permit the connection of the electrical lines leading to the components, and more particularly cables.

As regards of the electrical terminal means the electronic part is as a rule customized to suit the needs of the user. Dependent on the requirements of the respective application the terminal means are, dependent of the case in hand, designed as for example round plugs with different diameters, as flat plugs, or in an other suitable terminal technology. This leads to high production and stock holding costs, since a large number of different designs of the electronic part must be kept available.

OBJECTS AND SUMMARY OF THE INVENTION

Accordingly it is one object of the present invention to provide an electronic part of the type initially mentioned, whose electrical connection technology is so fashioned that the desires of the customer may be taken into account with less complexity and effort.

In order to achieve this object there is the provision that the terminal means are made part of at least one adapter, which is arranged in a replaceable manner on a mounting site, provided therefor, of a base of the electronic part, said base having the internal electronic unit, and said adapter possessing standardized first electrical interface means, said interface means being connected with the electronic terminal means, provided thereon, which interface means, on mounting and, respectively, dismounting of the adapter on and respectively from second electrical standardized interface means provided on the base and connected with the internal electronic unit, are electrically contacted and, respectively, put out of contact in such a manner that on one and the same mounting site the base may be selectively fitted with different adapters, which have respectively different electrical means.

It is in this manner that within the electronic part there is separation of electrical function and connection technology, the first and second electrical interface means, which cooperate with each other, constituting the disconnectable interface between the two components. The electrical or, respectively, electronic function, as for example preset control quantities and/or electronic memory measures, which is independent from the selected connection technology and in this respect does not need any adaptation, will remain as a component of the internal electronic unit in the base of the electronic part. The individually selected connection technology is provided on an adapter, which can be mounted on a mounting side provided for it on the base, there being the possibility of mounting the adapters, which as regards their connection technology are differently designed, selectively on one and the same mounting site. In order to fulfill different requirements of customers the electronic part is accordingly only to be fitted with the corresponding adapter, whose terminal means comply with the desired preset quantities or specifications. Such a modular design furthermore renders it possible to meet fluctuating demands for numbers of items, since a base fitted with the expensive electronic components may be made available in a uniform design structure for all applications, and it then merely has to be fitted with one or more adapters possessing the desired terminal means for customization. Moreover, the user has the possibility of being able to make later changes in the connection technology without having to completely change over the electronic part.

Further advantageous developments of the invention are defined in the dependent claims.

The electrical terminal means may for example form electrical outputs and/or inputs, which render possible the connection of sensors and/or actuators.

The electronic part may be so designed in a modular fashion that it possesses a plurality of adjacently placed electronic modules, which respectively possess at least one adapter and an accessory internal electronic unit.

The adapter will conveniently comprise one adapter housing, in which a contact means carrier is arranged, which bears both the first electrical interface means and also the electrical contact means of the associated electrical terminal means. This will render possible a separate production of the adapter components serving purely mechanical purposes and of those serving electrical purposes. In this case it is more especially possible for the electrical terminal means to possess mechanical attachment means, which render possible the mechanical fixation of the electrical lines to be connected, which lead to external equipment, and which are designed in the form of a component of the adapter housing, it is being more particularly possible to have an integral structure of the mechanical attachment means and of the adapter housing.

The contact means carrier is preferably designed in the form of a board or plate and may more especially be constituted by a printed circuit board fitted with contact means and with the first electrical interface means.

A particularly compact arrangement results if the adapter is designed as a cover of the base so that, when the adapter is removed, an access opening in the base is uncovered for the associated mounting site, such opening permitting access to the internal electronic unit.

The second electrical interface means responsible for producing the electrical connection with the adapter are preferably provided directly on the internal electronic unit and may thus be arranged directly thereon during the manufacture thereof.

The internal electronic unit is conveniently accommodated in a principal housing body of the electronic part, which together with the adapter, designed in the form of a cover, may constitute the housing of the electronic part.

The internal electronic unit is conveniently produced on a printed circuit board and accordingly can be produced in an extremely simple fashion and installed on the base.

In connection with the modular connection technology it is advantageous for any possibly present optical display means and/or markings, which for instance indicate the state of actuation of the internal electronic unit, not to be provided on the adapter but rather on the electronic unit. In this case same will not be touched on replacement of the adapter. In order nevertheless to leave the optical display and/or the markings readily visible from the outside for the observer, the adapter is preferably at least partially and preferably entirely made transparent, i. e. to this extent it consists of transparent material, and accordingly means that the optical displays and/or markings are conveniently made visible. In this connection it is possible to provide for the markings to be provided on a more particularly replaceable label means of the internal electronic unit, which may have light guide channels or conductors, through question the optical signals produced by the optical display means can be passed to a transparent portion of the adapter.

In the following the invention will be described in detail with reference to the accompanying drawings.

DETAILED DESCRIPTION OF THE PREFERRED EMBODIMENTS

Figure 1:
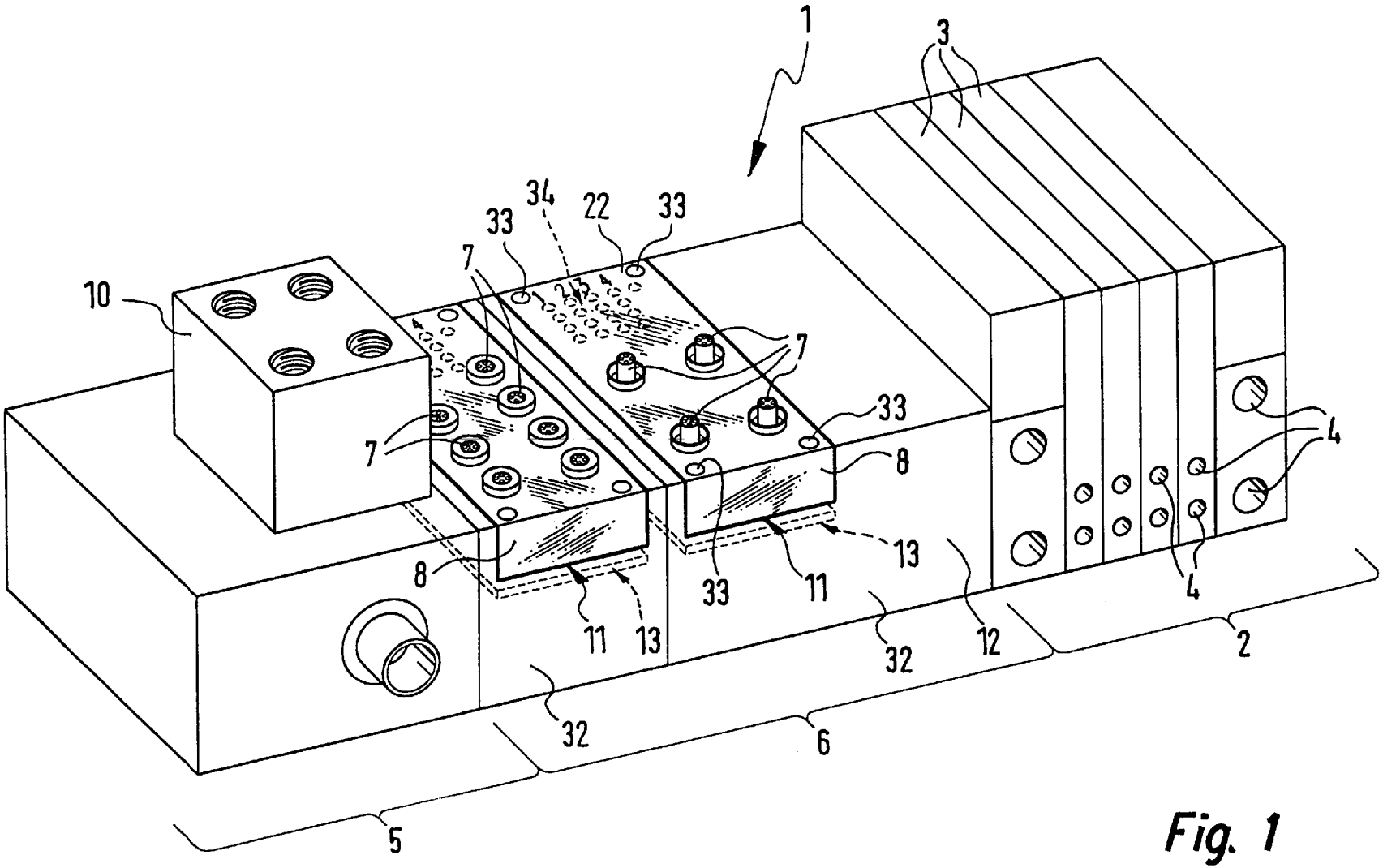
FIG. 1 shows a control means fitted with valves and which possesses a preferred embodiment of the electronic part in accordance with the invention.
Figure 2:
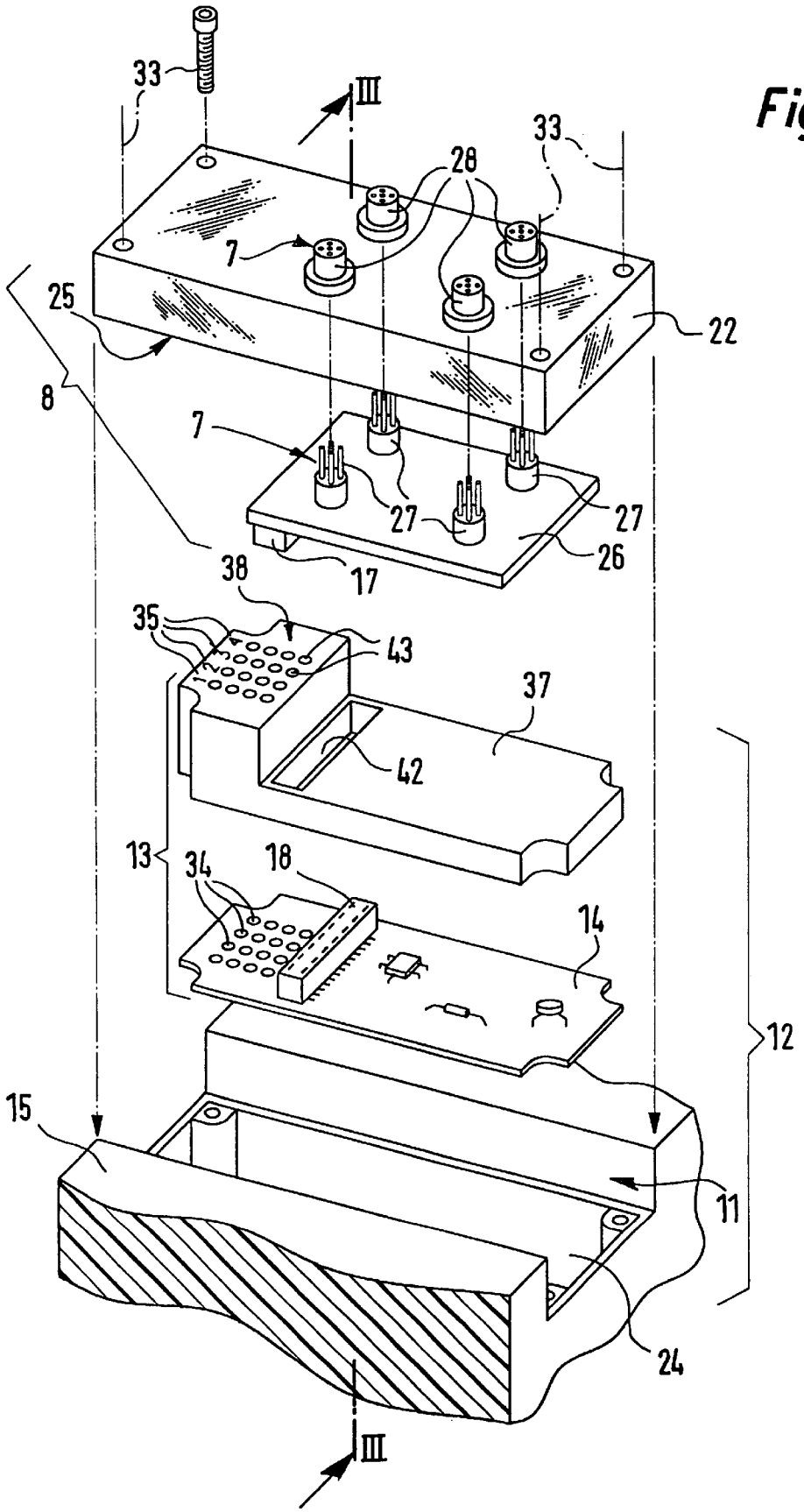
FIG. 2 is a representation of a part of the electronic part illustrated in FIG. 1 in a diagrammatic exploded view.

FIG. 1 shows a control means generally referenced 1, which can be employed in conjunction with the controlled operation of any desired actuators, in the case of which it may be a question of actuators operated electrically or by fluid power.

In the working embodiment the control means 1 comprises a valve part 2, which possesses a battery of valves 3, whose actuation is brought about by electrical signals. They contain electrically operated valve drives, as for instance electromagnets or by piezoelectric drives, not shown in detail. Dependent on the preset position of switching of a respective valve 3, connected loads, which are not illustrated, will be operated, such loads being for instance fluid power operated drives. At 4 connection openings will be seen, by way of which the pressure medium to be distributed is supplied and removed and with which fluid ducts can be connected, which lead to the loads to be supplied.

An electronic control part 5 of the control unit 1 comprises electronic control circuitry, by way of the valve drives of the valve part 2 may be supplied with control signals in the desired manner. The electronic control part 5 preferably contains a field bus unit 10, by way of which data communication may take place with a managing control and/or with other control means. Moreover, it is possible for the control, in case of need, to have its own, individually adapted control program.

A further component of the control means 1 is represented by the electronic part 6 in accordance with the invention. Same is internally wired with the electronic control part and comprises on its outer face a plurality of externally accessible electrical terminal means 7, which render possible the connection of at least one and preferably more electrical lines leading to external equipment, which is not illustrated in the drawings. The electrical lines are as a rule in the form of components of flexible cables and render possible, e. g., the connection of sensors or of electrical actuators such as solenoid valves or relays. In the working embodiment illustrated the electrical terminal or connection means 7 accordingly constitutes outputs and/or inputs for electrical signals, it certainly being possible for any desired control signals to be transmitted by way of the electrical terminal means in the one or the other direction.

The electrical terminal means 7 are, in the working embodiment of the invention, designed in the form of components of two adapters, that are respectively detachably and in a replaceable manner provided on a mounting site 11, provided therefor, on a base 12 of the electronic part 6. Each adapter 8 is provided with an internal electronic unit 13 placed in the interior of the base 12, each adapter 8 being best provided with its own electronic unit 13. Each electronic unit 13 is electrically connected with the electrical terminal means 7 of the adapter 8 associated with it.

The electronic unit 13 preferably comprises a printed circuit board 14 having electronic components and is accommodated in a principal housing body 15, which is at least partly hollow, of the electronic part 6. It is firmly anchored here by suitable attachment means 16, it however possible to provide a releasable mode of attachment which permits replacement.

The electrical connection between the electronic unit 13 and the electrical terminal or connection means 7 of the respectively associated adapter 8 is by way of mutually corresponding first and second interface means 17 and 18, which are provided on the one hand on the adapter 8 and on the other hand on the electronic unit 13. Whereas the second interface means 18, provided preferably directly on the printed circuit board 14, are connected with the electronic components of the electronic unit 13, the first interface means 17 are connected within the adapter 8 by way of electrical lines 9 with its electrical connection or terminal means 7.

While the electrical terminal means 7 of the individual adapters 8 may differ in their specific design and more particularly in the specific connection technology, the first and second interface means 17 and 18 cooperating with one another are the same in each pair of adapters and electronic unit and therefore looked upon as standardized components. In the working embodiment illustrated same are constituted by plug means, which are more especially in the form of rows of plugs and jacks able to be inserted into each other. If one adapter 8 is mounted on one of the mounting sites 11, then on putting in place electrical contact will be made directly between the first and second interface means 17 and 18. In similar fashion, on the removal of an adapter 8 from the base 12, such electrical connection will be automatically disconnected.

In the electronic units 13 the electrical and, respectively, electronic functions to be implemented by the electronic part 6 are collected together. The adapters 8 only have terminal technology which is required in order to render possible electrical connection of the external line leading to external equipment, in accordance with certain mechanical prerequirements. As a result of the necessity to have differently designed electrical terminal means 7 for the users of the control means 1—owing to the pre-existing electrical installation specific to the user—the design of the electronic part 6 in accordance with the invention does offer the possibility of fitting the base 12 on each individual mounting site 11 selectively with different adapters 8, same having mutually different terminal or connection means 7. There is consequently the possibility of designing the electronic part 6 individually and in a customized manner with the respectively required connection or terminal technology with little expense and effort.

In order to have a compact overall form the adapters 8 of the working embodiment have such a structure that they constitute a cover 23 for the base 12. The principal housing body 15 is provided with an access opening 24 adjacent to the mounting sites 11 respectively, such access opening 24 being open when the adapter 8 is removed and conveniently it provides access to the internal electronic unit 13 in the interior of the principal housing body 15. Once the adapter 8 is installed it will cover the access opening 24, preferably with a sealing effect so that the housing of the electronic part 6 will be sealed off on all sides.

Each respective adapter 8 will preferably have an adapter housing 22, which in the working embodiment is like a box, and has an open bottom side 25, which in the mounted state faces the mounting site 11. In the interior of the adapter housing 22 there is a contact means carrier 26, which is preferably designed like a board and more particularly is constituted by a printed circuit board fitted with suitable components. On the one hand it bears the first electrical interface means 17 and on the other hand the electrical contact means 27 of the electrical terminal means 7. Moreover, it possesses electrical lines 9 preferably in the form of printed wiring, connecting the first interface means 17 with the electrical contact means 27 electrically with the appropriate coordination.

The electrical terminal means 7 are preferably provided with mechanical attachment means 28, which render possible the mechanical fixation in place of the electrical lines, connected with external equipment, to be connected with the electronic part. The attachment means 28 may for instance be simple plug tailpieces, screw threaded means or bayonet fasteners. Although it would in principle be possible to apply the mechanical attachment means 28 as separate parts on the adapter housing 22, it is more satisfactory to adopt the structural design employed in the embodiment of the invention having an integral connection between the attachment means 28 and the adapter housing 22. Accordingly simple and economic production is possible, for example by injection molding.

The contact means carrier 26 and the adapter housing 22 are initially separate and are joined together to form the adapter 8. For this purpose, in the working example, the board-like contact means carrier 26 or support is inserted through the open bottom side 25 into the adapter housing 22, the electrical contact means 27 then uniting with the mechanical attachment means 28 to give the electrical terminal means 7. In the working embodiment illustrated the mechanical attachment means 28 for this purpose respectively possess an outwardly extending spur provided with one or more through openings, through which the pin-like electrical contact means 27 fit on insertion of the contact carrier 26. The contact means carrier 26 is secured in place by suitable holding means 32 in the adapter's housing 22, for example using a catch or detent.

It will be clear that the electrical contact means 27 and the mechanical attachment means 28 may be provided alternatively on a uniform adapter body. The multi-part design does however offer manufacturing advantages.

Figure 3:
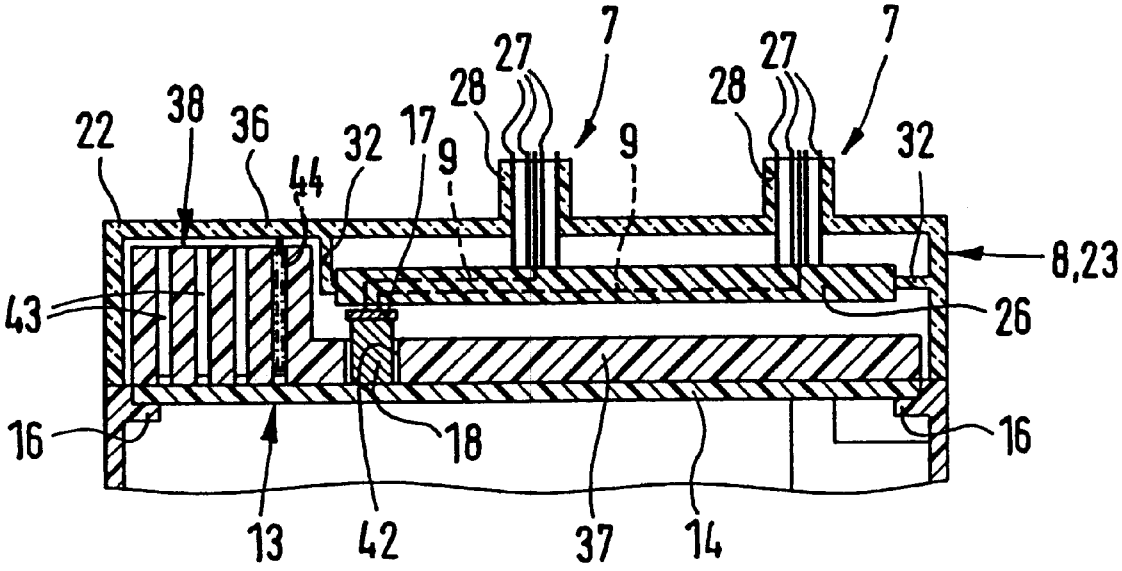
FIG. 3 shows the arrangement of FIG. 2 in the assembled state in a longitudinal section taken generally on the line III—III of FIG. 2.

With the adapter 8 in the mounted condition in the working example of the invention the contact carrier 26 and the printed circuit board 14 of the associated electronic unit 23 preferably extend in plane parallelism so that it is possible to speak of a layered or laminate structure, which as is to be seen from FIG. 3 may be made extremely compact.

As shown in FIG. 1 the adapter 8 may be let into the base so that there is no interfering, projecting part and a further precondition for a compact structure is fulfilled.

In the working embodiment illustrated in FIG. 1 the electrical part 6 is also modular in design to the extent that it is composed of a plurality of electronic modules 32 detachably connected together. Each of such electronic modules 32 contains an internal electronic unit 13 and an associated adapter 8. Dependent on specific needs a plurality of such modules 32 may be placed in a row in order to enlarge the control means 1 as may be required.

It is to be pointed out that it is quite possible for the electronic part 6 to have only a single adapter 8, which has the connection technology required at a specific time. One and the same mounting site may in this case bear different adapters.

For the detachable and replaceable attachment of the adapter on the base 12 in the working example attachment means 33 in the form of screw threaded connecting means are provided. However, other structures would be possible, as for example attachment by catch means.

The electronic part 6 is provided with optical display means able to emit optical signals to indicate specific states of operation. Thus, for example the display of certain operational states of connected sensors or actuators may take place. It is convenient for the optical display means 34 to be in the form of luminous means, as for instance in the form of LEDs.

Furthermore the electronic part 6 has markings 35, more particularly in the form of lettering, which are associated with the optical display means 34 and which render it possible for an observer to see the significance of an optical signal.

It is an advantage for both the optical display means 34 and also the markings 35 to be provided on the internal electronic unit, which then independently of the respectively utilized adapter 8 remains in place. This offers the advantage that the display and marking features are limited to the electronic unit 13, whereas the adapters 8 (of which there may be a fair number) possibly provided do not themselves have to be provided with display means or even markings.

In the working embodiment illustrated the optical display means 34 are located on the top side, facing the adapter 8, of the printed circuit board 14. In order to render the optical signals visible for an outside observer, the adapter housing 22 is, at least in the region opposite to the optical display means 34, made transparent and here is more particularly made of transparent plastic material. In order to allow for simple production it is convenient for the entire adapter housing 32 to be transparent.

The markings 35 may be also provided directly on the printed circuit board 14 of the electronic unit 13. They may, like the optical signals, be seen or detected from the outside through the at least partially transparent adapter housing 22.

However if the printed circuit board 14, as illustrated, is arranged at a fair distance from the wall 36, parallel to it, of the adapter housing 32, it is best to have the additional label means 37, as in the illustrated working example, between the said housing wall 36 and the printed circuit board 14 of the electronic unit 13 to carry the marking. This label means 37 can be considered to be a part of the electronic unit 13 and will remain a part thereof even when a one adapter is replaced by another one. It could be permanently attached to the printed circuit board 14, it being best to have exchangeable configuration to allow for variability.

The marking support 37 possesses a label face 38 having the markings, which when the adapter 8 is mounted assumes a position directly adjacent to the above mentioned housing wall 36. The markings 35 may accordingly be readily seen through the transparent housing which 36.

It is convenient for the marking support or label means 37 to possess one or more through openings 42, through which the first and second interface means 17 and 18 may be readily contacted electrically.

In order to prevent the label means 37 interfering with reading the signals from the optical display means 34, the label means 37 is, in the working embodiment, provided with light guide channels 43, which conduct the optical signals produced at the printed circuit board 14 as far as the support face 38 so that same then appear adjacent to the markings 35. It will be clear that instead of having individual light guide channels 43 the label means 37 having the markings thereon could be made completely transparent, at least in the section between the optical display means 34 and the opposite wall 36 of the adapter housing 22.

A still further possibility for bridging over the gap between the optical display means 34 and the opposite wall 36 of the adapter housing 32 is by providing light guide projections on the inner face of the above mentioned housing wall 36, which projections are more particularly pin-like and extend as far as the optical display 34 on the printed circuit board 14. FIG. 3 shows an example of such a light guide projection at 44 as indicated in chained lines. The light guide projections 44 are preferably fashioned of light conducting material, as for instance of transparent plastic material and conduct the light signals from the display means as dots to a transparent region of the adapter housing 32. It is preferred for them to be integral with the adapter housing 32.

The light guide projections 44 may also be provided in association with a label means 37. Its light guide channels 43 may be in the form of simple openings, into which the light guide projections 44 extend or, respectively, have the light guide projections 44 extending through them.

What is claimed is:

1. An electronic part more especially for a control means having valves, comprising externally accessible electrical terminal or connection means for the connection of at least one electrical conductor leading to external equipment and at least one internal electronic unit, which is connected with the electrical terminal means electrically, characterized in that the terminal means are made part of at least one adapter, which is arranged in a replaceable manner on a mounting site, provided therefor, of a base of the electronic part, said base having the internal electronic unit, and said adapter possessing standardized first electrical interface means, said interface means being connected with the electronic terminal means, provided thereon, which interface means, on mounting and, respectively, dismounting of the adapter on and respectively from second electrical standardized interface means provided on the base and connected with the internal electronic unit, are electrically contacted and, respectively, put out of contact in such a manner that on one and the same mounting site the base may be selectively fitted with different adapters, which have respectively different electrical means, wherein the adapter comprises an adapter housing, in which a contact means carrier is arranged, which bears the first electrical interface means and at least the electrical contact means of the electronic terminal means, and wherein the contact means carrier is board-like and more particularly is constituted by a printed circuit board bearing the electrical contact means and the first electrical interface means.

2. An electronic part more especially for a control means having valves, comprising externally accessible electrical terminal or connection means for the connection of at least one electrical conductor leading to external equipment and at least one internal electronic unit, which is connected with the electrical terminal means electrically, characterized in that the terminal means are made part of at least one adapter, which is arranged in a replaceable manner on a mounting site, provided therefor, of a base of the electronic part, said base having the internal electronic unit, and said adapter possessing standardized first electrical interface means, said interface means being connected with the electronic terminal means, provided thereon, which interface means, on mounting and, respectively, dismounting of the adapter on and respectively from second electrical standardized interface means provided on the base and connected with the internal electronic unit, are electrically contacted and, respectively, put out of contact in such a manner that on one and the same mounting site the base maybe selectively fitted with different adapters, which have respectively different electrical means, wherein the internal electronic unit contains a printed circuit board bearing electronic components.

3. An electronic part more especially for a control means having valves, comprising externally accessible electrical terminal or connection means for the connection of at least one electrical conductor leading to external equipment and at least one internal electronic unit, which is connected with the electrical terminal means electrically, characterized in that the terminal means are made part of at least one adapter, which is arranged in a replaceable manner on a mounting site, provided therefor, of a base of the electronic part, said base having the internal electronic unit, and said adapter possessing standardized first electrical interface means, said interface means being connected with the electronic terminal means, provided thereon, which interface means, on mounting and, respectively, dismounting of the adapter on and respectively from second electrical standardized interface means provided on the base and connected with the internal electronic unit, are electrically contacted and, respectively, put out of contact in such a manner that on one and the same mounting site the base may be selectively fitted with different adapters, which have respectively different electrical means, wherein the internal electronic unit is fitted with optical display means, whose optical signals are visible from the outside through the adapter which is made at least partially transparent.

4. The electronic part as claimed in claim 3, characterized in that the adapter (8) includes an adapter housing which for rendering the optical display means (34) visible has an at least partly and preferably completely transparent adapter housing (22).

5. The electronic part as claimed in claim 4, characterized by pin-like light guide projections (44) provided on the adapter housing (22), such pins extending from a transparent zone of the adapter housing (22) as far as the optical display means (34).

6. An electronic part more especially for a control means having valves, comprising externally accessible electrical terminal or connection means for the connection of at least one electrical conductor leading to external equipment and at least one internal electronic unit, which is connected with the electrical terminal means electrically, characterized in that the terminal means are made part of at least one adapter, which is arranged in a replaceable manner on a mounting site, provided therefor, of a base of the electronic part, said base having the internal electronic unit, and said adapter possessing standardized first electrical interface means, said interface means being connected with the electronic terminal means, provided thereon, which interface means, on mounting and, respectively, dismounting of the adapter on and respectively from second electrical standardized interface means provided on the base and connected with the internal electronic unit, are electrically contacted and, respectively, put out of contact in such a manner that on one and the same mounting site the base may be selectively fitted with different adapters, which have respectively different electrical means, wherein the internal electronic unit is provided with markings, the markings being arranged on a label means forming part of the internal electronic unit and being visible through the adapter from the outside, and wherein the label means has light guide channels through which light signals originating from an optical display means may pass to a transparent zone of the adapter.

7. The electronic part as claimed in claim 6, characterized in that light guide projections provided on the adapter housing (22) extend into the light guide channels (43).

8. An electronic part for a control means having valves comprising:

at least one adapter including an externally accessible electrical terminal for connection to at least one electrical conductor leading to external equipment and a standardized first electrical interface electrically connected to the externally accessible electrical terminal; and a base having a mounting site for replaceably receiving the at least one adapter, the base including at least one internal electronic unit and a standardized second electrical interface electrically connected to the at least one internal electronic unit, the standardized second electrical interface releasably engaging the standardized first electrical interface for electrically connecting the at least one internal electronic unit to the externally accessible electrical terminal upon mounting the at least one adapter to the base.

9. The electronic part as claimed in claim 8, wherein the electrical terminal comprises electrical connectors for connection of external equipment.

10. The electronic part as claimed in claim 8, wherein the electronic part is modular and comprises a plurality of electronic modules each electronic module having at least one adapter.

11. The electronic part as claimed in claim 8, wherein the adapter comprises a cover of the base such that when the adapter is removed, an access opening in the base is defined for accessing the internal electronic unit.

12. The electronic part as claimed in claim 8, wherein the second electrical interface is provided on the internal electronic unit.

13. The electronic part as claimed in claim 8, wherein the internal electronic unit is accommodated in a principal housing body of the electronic part.

14. The electronic part as claimed in claim 8, wherein the first and the second electrical interfaces comprise rows of plug elements.

15. The electronic part as claimed in claim 8, wherein the adapter comprises an adapter housing having a contact means carrier arranged therein, the contact means carrier including the first electrical interface and an electrical contact of the electrical terminal.

16. The electrical part as claimed in claim 15, wherein the electrical terminal comprises mechanical attachments provided on the adapter housing for the attachment of electrical lines leading to external equipment.

17. The electrical part as claimed in claim 16, wherein the mechanical attachments are at least partially designed in the form of an integral component of the adapter housing.

18. The electronic part as claimed in claim 8, wherein the internal electronic unit is provided with markings, the markings being visible through the adapter from the outside.

19. The electronic part as claimed in claim 18, wherein the markings are associated with an optical display provided on the internal electronic unit.

20. The electronic part as claimed in claim 18, wherein the markings are arranged on a label forming part of the internal electronic unit.

21. The electronic part as claimed in claim 20, wherein the label is replaceable.

* * * * *